US009976224B2

(12) United States Patent
Jeong et al.

(10) Patent No.: US 9,976,224 B2
(45) Date of Patent: May 22, 2018

(54) CHIP ELECTRONIC COMPONENT AND MANUFACTURING METHOD THEREOF

(71) Applicant: SAMSUNG ELECTRO-MECHANICS CO., LTD., Suwon-Si, Gyeonggi-Do (KR)

(72) Inventors: Dong Jin Jeong, Suwon-Si (KR); Sung Hoon Kim, Suwon-Si (KR); Byung Seung Min, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 61 days.

(21) Appl. No.: 14/284,236

(22) Filed: May 21, 2014

(65) Prior Publication Data

US 2015/0170823 A1 Jun. 18, 2015

(30) Foreign Application Priority Data

Dec. 18, 2013 (KR) ..... 10-2013-0158078

(51) Int. Cl.
*H01F 5/00* (2006.01)
*H01F 27/28* (2006.01)
(Continued)

(52) U.S. Cl.
CPC ..... *C25D 7/001* (2013.01); *H01F 17/0013* (2013.01); *H01F 27/292* (2013.01); *H01F 41/046* (2013.01); *H01F 2017/048* (2013.01)

(58) Field of Classification Search
CPC ..... H01F 17/0013; H01F 17/0006; H01F 27/2804; H01F 17/0033; H01F 41/041; H01F 27/24; H01L 23/5227
(Continued)

(56) References Cited

U.S. PATENT DOCUMENTS 6,600,404 B1 * 7/2003 Kajino ..... H01F 5/003 257/531
7,759,776 B2 * 7/2010 Cheng ..... G01R 1/07378 257/659
(Continued)

FOREIGN PATENT DOCUMENTS

CN 1523617 A 8/2004
CN 101046482 A 10/2007
(Continued)

OTHER PUBLICATIONS

Notice of Office Action Korean Patent Application No. 10-2013-0158078 dated Nov. 10, 2014 with full English translation.
(Continued)

*Primary Examiner* — Elvin G Enad
*Assistant Examiner* — Kazi Hossain
(74) *Attorney, Agent, or Firm* — McDermott Will & Emery LLP

(57) ABSTRACT

There are provided a chip electronic component comprising: a magnetic body including an insulation substrate; an internal coil part formed on at least one surface of the insulation substrate; and an external electrode formed on an end surface of the magnetic body and connected to the internal coil part, wherein the internal coil part includes a first coil pattern formed on the insulation substrate and a second coil pattern formed to coat the first coil pattern, and a ratio a/b of a width a of an upper surface of the first coil pattern with respect to a width b of a lower surface of the first coil pattern is less than 1.

13 Claims, 4 Drawing Sheets

(51) Int. Cl.

| | |
|---|---|
| ***H01F 27/24*** | (2006.01) |
| ***C25D 7/00*** | (2006.01) |
| ***H01F 17/00*** | (2006.01) |
| ***H01F 27/29*** | (2006.01) |
| ***H01F 41/04*** | (2006.01) |
| *H01F 17/04* | (2006.01) |

(58) Field of Classification Search
USPC ..... 336/200, 232, 234
See application file for complete search history.

(56) References Cited

U.S. PATENT DOCUMENTS

| | | | | |
|---|---|---|---|---|
| 7,870,665 | B2 | 1/2011 | Nomura et al. | |
| 9,236,171 | B2 | 1/2016 | Ito et al. | |
| 2001/0024739 | A1* | 9/2001 | Mizoguchi | H01F 17/0006 428/606 |
| 2002/0105405 | A1* | 8/2002 | Lee | H01F 5/003 336/200 |
| 2004/0164835 | A1 | 8/2004 | Shoji | |
| 2008/0204183 | A1* | 8/2008 | Loza | H01F 17/0013 336/200 |
| 2011/0133881 | A1* | 6/2011 | Nakajima | H01F 3/14 336/200 |
| 2012/0154099 | A1* | 6/2012 | Fukuda | H01B 3/301 336/222 |
| 2013/0107580 | A1* | 5/2013 | Inaba | H01F 27/306 363/16 |
| 2013/0222101 | A1* | 8/2013 | Ito | H01F 17/04 336/83 |
| 2013/0249662 | A1* | 9/2013 | Tonoyama | H01F 27/255 336/200 |
| 2014/0167897 | A1* | 6/2014 | Choi | H01F 27/255 336/83 |
| 2015/0091688 | A1* | 4/2015 | Jung | H01F 17/0006 336/200 |

FOREIGN PATENT DOCUMENTS

| | | | |
|---|---|---|---|
| CN | 103180919 | A | 6/2013 |
| JP | H10-241983 | A | 9/1998 |
| JP | 2004-319570 | A | 11/2004 |
| JP | 2004-342645 | A | 12/2004 |
| JP | 2006-278479 | A | 10/2006 |
| JP | 2006-310716 | A | 11/2006 |
| KR | 1999-0066108 | A | 8/1999 |
| KR | 10-2013-0031082 | A | 3/2013 |

OTHER PUBLICATIONS

Chinese Office Action dated Jun. 3, 2016, issued in Chinese Patent Application No. 201410174312.4. (w/ English translation).
Chinese Office Action dated Jan. 18, 2017, issued in Chinese Patent Application No. 201410174312.4. (w/ English translation).
Third Chinese Office Action issued in Chinese Patent Application No. 201410174312.4, dated Jul. 20, 2017 (with English Translation).

* cited by examiner

CHIP ELECTRONIC COMPONENT AND MANUFACTURING METHOD THEREOF

CROSS-REFERENCE TO RELATED APPLICATION

This application claims the benefit of Korean Patent Application No. 10-2013-0158078 filed on Dec. 18, 2013, with the Korean Intellectual Property Office, the disclosure of which is incorporated herein by reference.

BACKGROUND

The present disclosure relates to a chip electronic component and a manufacturing method thereof.

An inductor, a chip electronic component, is a representative passive element configuring an electronic circuit together with a resistor and a capacitor to remove noise. The inductor is combined with the capacitor using an electromagnetic property to configure a resonance circuit amplifying a signal in a specific frequency band, a filter circuit, or the like.

Recently, as miniaturization and thinness of information technology (IT) devices such as various communications devices, display devices, or the like, has been accelerated, research into a technology for miniaturizing and thinning various elements such as inductors, capacitors, transistors, and the like, used in the IT devices has continued. Inductors have also been rapidly replaced by chips having a small size and a high density and capable of being automatically surface-mounted. Thin film-type inductors in which mixtures of magnetic powder particles and resins are formed on coil patterns formed by plating on upper and lower surfaces of thin film insulating substrates have been developed.

Direct current resistance Rdc, a main characteristic of an inductor, is decreased as a cross-sectional area of a coil is increased. Therefore, in order to decrease direct current resistance Rdc and increase an inductance value, a cross-sectional area of an internal coil needs to be increased.

Two methods are commonly used for increasing a cross sectional area of a coil pattern, namely, a method of increasing a width thereof and a method of increasing a thickness thereof.

In the case of increasing a width of the coil pattern, the occurrence of short circuits between coil patterns may be significantly increased, and the amount of turns able to be implemented in an inductor chip may be decreased, leading to a decrease in an area occupied by a magnetic material, such that inductor efficiency may be deteriorated and a limitation in implementing high capacity products.

Therefore, a structure in which the internal coil of the thin film inductor has a high aspect ratio (AR) by a coil pattern thickness being increased has been required. The aspect ratio (AR) of the internal coil indicates a value obtained by dividing the thickness of the coil pattern by the width of the coil pattern, and in order to implement a relatively high aspect ratio (AR), an increase in a width of a coil pattern should be suppressed, and an increase in a thickness of a coil pattern should be promoted.

However, in the case in which internal coils are formed by an existing pattern plating method using a plating resist, in order to increase a coil pattern thickness, a plating resist thickness should be increased and the plating resist having an increased thickness should have a predetermined width or more to maintain a shape thereof, thereby causing a problem such as an increase in an interval between coil patterns.

In addition, when internal coils are formed using an electroplating process according to the related art, due to isotropic growth of a coil pattern in which the coil pattern is grown in width and thickness directions, short circuits between coil patterns may occur, and a limitation in implementing a relatively high aspect ratio (AR) of a coil may be present.

SUMMARY

Some embodiments of the present disclosure may provide a chip electronic component capable of preventing the occurrence of short-circuits between coil patterns and implementing a high aspect ratio (AR) by relatively increasing a coil thickness as compared to a width thereof, and a manufacturing method thereof.

According to some embodiments of the present disclosure, a chip electronic component may include: a magnetic body including an insulation substrate; an internal coil part formed on at least one surface of the insulation substrate; and an external electrode formed on an end surface of the magnetic body and connected to the internal coil part, wherein the internal coil part includes a first coil pattern formed on the insulation substrate and a second coil pattern formed to coat the first coil pattern, and a ratio a/b of a width a of an upper surface of the first coil pattern with respect to a width b of a lower surface thereof is less than 1.

The ratio a/b of the width a of the upper surface of the first coil pattern with respect to the width b of the lower surface thereof may satisfy $0.5 \leq a/b < 1$.

A cross-section of the first coil pattern may have a thickness direction trapezoidal shape of which a length of a lower surface is greater than that of an upper surface.

The width b of the lower surface of the first coil pattern may be 90 to 110 μm.

The width a of the upper surface of the first coil pattern may be 70 to 90 ρm.

The internal coil part may further include a third coil pattern coating the second coil pattern.

A ratio a'/b' of a width a' of an upper surface of the internal coil part with respect to a width b' of a lower surface thereof may be less than 1.

The internal coil part may contain one or more selected from a group consisting of silver (Ag), palladium (Pd), aluminum (Al), nickel (Ni), titanium (Ti), gold (Au), copper (Cu), and platinum (Pt).

The first coil pattern and the second coil pattern may be formed of a single type of metal.

The internal coil part may have an aspect ratio of 1.1 or more.

According to some embodiments of the present disclosure, a method of manufacturing a chip electronic component, the method may include: forming an internal coil part on at least one surface of an insulation substrate; forming a magnetic body by stacking magnetic layers on upper and lower portions of the insulation substrate on which the internal coil part is formed; and forming an external electrode on at least one end surface of the magnetic body to be connected to the internal coil part, wherein in the forming of the internal coil part, a first coil pattern is formed on the insulation substrate, a second coil pattern coating the first coil pattern is formed, and the first coil pattern is formed so that a ratio a/b of a width a of an upper surface thereof with respect to a width b of a lower surface thereof is less than 1.

The forming of the internal coil part may include: forming a plating resist having an open portion for the formation of the first coil pattern on the insulation substrate; forming the first coil pattern by filling the open portion with a conductive metal; removing the plating resist; and forming the second coil pattern on the first coil pattern to coat the first coil pattern using an electroplating process. The open portion, for the formation of the first coil pattern, may be formed so that a ratio of atop opening width thereof with respect to a bottom opening width thereof is less than 1.

The first coil pattern may be formed so that the ratio a/b of the width a of the upper surface thereof with respect to the width b of the lower surface thereof satisfies $0.5 \leq a/b < 1$.

A cross-section of the first coil pattern may have a thickness direction trapezoidal shape of which a length of a lower surface is greater than that of an upper surface.

The width b of the lower surface of the first coil pattern may be 90 to 110 μm.

The width a of the upper surface of the first coil pattern may be 70 to 90 μm.

The forming of the internal coil part may further include forming a third coil pattern coating the second coil pattern by performing an electroplating process on the second coil pattern.

The internal coil part may be formed so that a ratio a'/b' of a width a' of an upper surface thereof with respect to a width b' of a lower surface thereof is less than 1.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
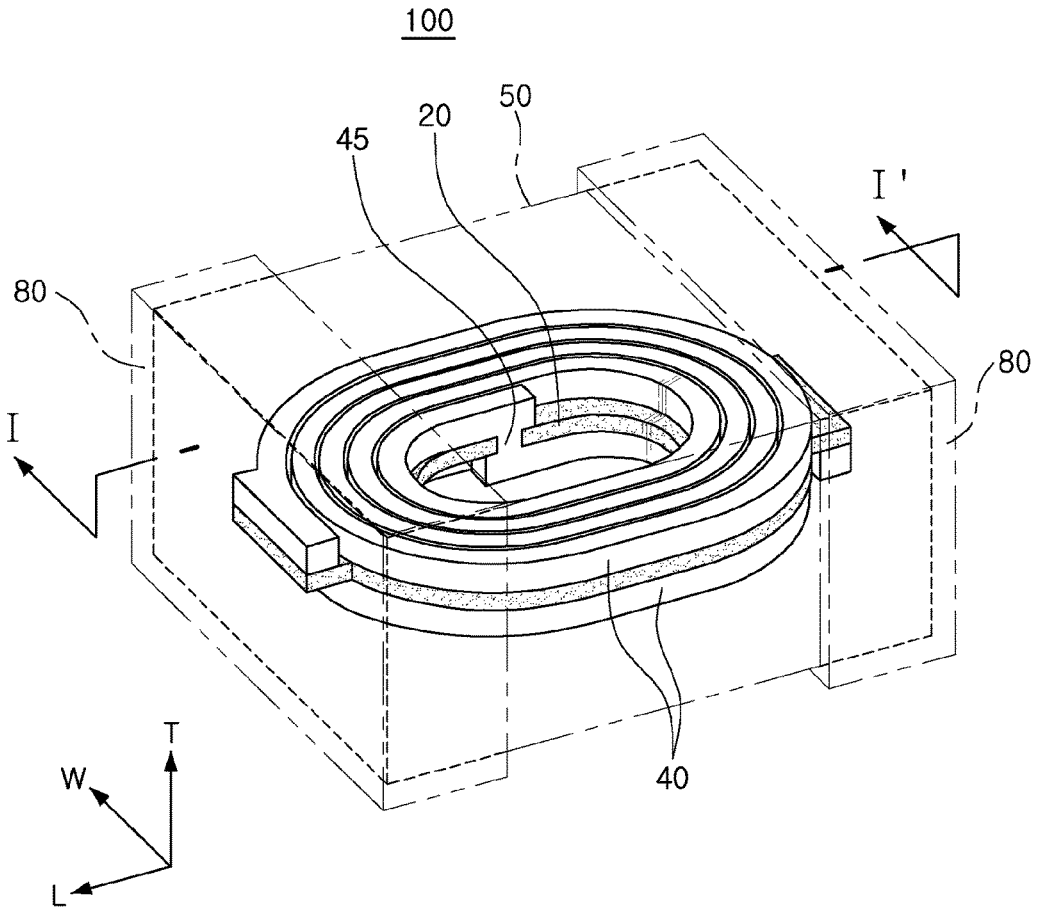
FIG. 1 is a schematic perspective view illustrating a chip electronic component including an internal coil part according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure will be described. For example, a thin film-type inductor will be described, but the present disclosure is not limited thereto.

Figure 2:
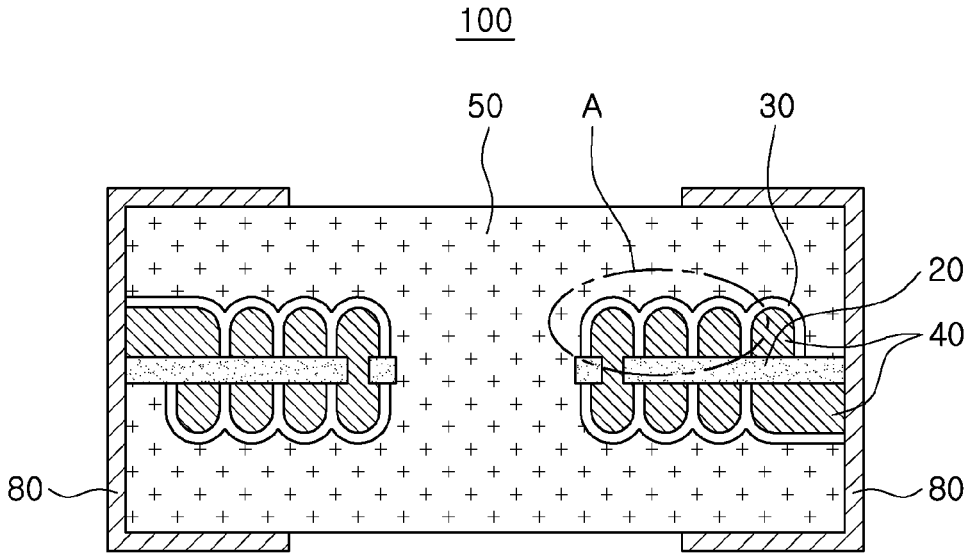
FIG. 2 is a cross-sectional view taken along line I-I' of FIG. 1.
Figure 3:
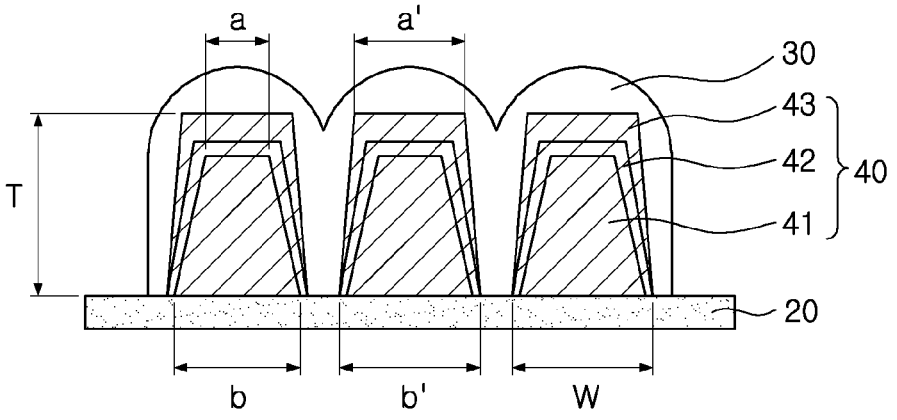
FIG. 3 is an enlarged schematic diagram of part A of FIG. 2 according to the exemplary embodiment of the present disclosure.

FIG. 1 is a schematic perspective view illustrating a chip electronic component including an internal coil part according to an exemplary embodiment of the present disclosure, FIG. 2 is a cross-sectional view taken along line I-I' of FIG. 1, and FIG. 3 is an enlarged schematic diagram of part A of FIG. according to the exemplary embodiment of the present disclosure.

Referring to FIGS. 1 to 3, as an example of the chip electronic component, a thin film inductor 100 used in a power line of a power supply circuit is provided. The chip electronic component may be appropriately applied as a chip bead, a chip filter, and the like, as well as the chip inductor.

The thin film inductor 100 may include a magnetic body 50, an insulation substrate 20, an internal coil part 40, and an external electrode 80.

The magnetic body 50 may provide an appearance of the thin film inductor 100, and may be formed by being filled with ferrite or metal-based soft magnetic materials, but a material forming the magnetic body is not particularly limited as long as the material has magnetic properties.

As the ferrite, publicly disclosed ferrite such as Mn—Zn-based ferrite, Ni—Zn-based ferrite, Ni—Zn—Cu-based ferrite, Mn—Mg-based ferrite, Ba-based ferrite, and Li-based ferrite may be used.

An example of the metal-based soft magnetic material may include an alloy containing one or more selected from a group consisting of Fe, Si, Cr, Al and Ni, and for example, the metal-based soft magnetic material may contain Fe—Si—B—Cr-based amorphous metal particles, but the present disclosure is not limited thereto.

The metal-based soft magnetic material may have a particle diameter of 0.1 μm to 20 μm, and particles thereof may be dispersed on a polymer such as an epoxy resin, polyimide, or the like.

The magnetic body 50 may have a hexahedral shape. Directions in a hexahedron will be defined to clearly describe the exemplary embodiments of the present disclosure. T, L, and W shown in FIG. 1 refer to a thickness direction, a length direction, and a width direction, respectively. The magnetic body 50 may have a rectangular parallelepiped shape.

The insulation substrate 20 formed in the magnetic body 50 may be, for example, a polypropylene glycol (PPG) substrate, a ferrite substrate, a metal based soft magnetic substrate, or the like.

A central portion of the insulation substrate 20 may have a hole to penetrate therethrough and the hole may be filled with a magnetic material such as ferrite or a metal-based soft magnetic material, or the like, to thereby form a core part therein. The core part filled with the magnetic material may improve inductance (L).

One surface of the insulation substrate 20 may be provided with the internal coil part 40 having a coil-shaped pattern and the other surface of the insulation substrate 20 may also be provided with the internal coil part 40 having a coil-shaped pattern.

The internal coil part 40 may have a spiral-shaped coil pattern, and the internal coil parts 40 formed on one surface of the insulation substrate 20 and the other surface thereof may be electrically connected through a via electrode 45 formed on the insulation substrate 20.

The internal coil part 40 may include a first coil pattern 41 formed on the insulation substrate 20 and a second coil pattern 42 formed to coat the first coil pattern 41. A ratio a/b of a width a of an upper surface of the first coil pattern 41 with respect to a width b of a lower surface thereof may be less than 1.

The lower surface of the first coil pattern 41 refers to a surface thereof contacting the insulation substrate 20 and the upper surface of the first coil pattern 41 refers to a surface of the first coil pattern opposing the surface contacting the insulation substrate 20.

Since a ratio a/b of a width a of an upper surface of the first coil pattern 41 with respect to a width b of a lower surface thereof is less than 1, the width b of the lower surface may be greater than the width a of the upper surface of the first coil pattern 41.

In the case in which the ratio a/b of a width a of an upper surface of the first coil pattern 41 with respect to a width b of a lower surface thereof is 1 or more, for example, in a case in which the width b of the lower surface is the same as or narrower than the width a of the upper surface, due to isotropic growth of the second coil pattern 42 or the third coil pattern 43 formed using an electroplating process on the first coil pattern 41, a defect such as short circuits between coil patterns may occur and a limitation in increasing an aspect ratio (AR) of the coil may be present.

For example, the ratio a/b of the width a of the upper surface of the first coil pattern 41 with respect to the width b of the lower surface thereof may satisfy $0.5 \leq a/b < 1$.

The width b of the lower surface of the first coil pattern 41 may be 90 μm to 110 μm, and the width a of the upper surface of the first coil pattern 41 may be 70 μm to 90 μm.

A cross-section of the first coil pattern 41 may have a thickness direction trapezoidal shape of which a length of a lower surface is greater than that of an upper surface.

The first coil pattern 41 may be formed by forming a patterned plating resist on the insulation substrate 20 and filling an open portion with a conductive metal.

In the case of the open portion, for example, a bottom opening width thereof is wider than a top opening width thereof, such that the first coil pattern 41 in which the ratio a/b of a width a of an upper surface of the first coil pattern 41 with respect to a width b of a lower surface thereof is less than 1 may be formed.

The second coil pattern 42 may be formed by using the first coil pattern 41 as a seed layer and performing an electroplating process.

An electroplating process may be performed on the second coil pattern 42, and therefore, a third coil pattern 43 coating the second coil pattern 42 may be further formed thereon.

The first coil pattern 41 in which the ratio a/b of a width a of an upper surface thereof with respect to a width b of a lower surface thereof is less than 1 may be formed, and the second coil pattern 42 and the third coil pattern 43 may be formed on the first coil pattern 41 so as to coat the first coil pattern 41, thereby increasing a thickness of the coil pattern and preventing the occurrence of short-circuits between coil patterns. Thus, the internal coil part 40 having a relatively high aspect ratio (AR) may be implemented.

In the case of the internal coil part 40, a ratio a'/b' of a width a' of an upper surface of the internal coil part with respect to a width b' of the lower surface thereof may be less than 1.

The lower surface of the internal coil part 40 refers to a surface thereof contacting the insulation substrate 20, and the upper surface of the internal coil part 40 refers to an outermost surface of the internal coil part 40 opposing the surface thereof contacting the insulation substrate 20, for example, an upper surface of the second coil pattern 42 or an upper surface of the third coil pattern 43.

The internal coil part 40 may contain a metal having excellent electric conductivity. For example, the internal coil part 40 may be formed of silver (Ag), palladium (Pd), aluminum (Al), nickel (Ni), titanium (Ti), gold (Au), copper (Cu), platinum (Pt), an alloy thereof, or the like.

The first coil pattern 41, the second coil pattern 42, and the third coil pattern 43 may be made of a single type of metal, and in further detail, may be made of copper (Cu).

The internal coil part 40 may include the first coil pattern 41 in which a ratio a/b of a width a of an upper surface with respect to a width b of a lower surface is less than 1, and the second coil pattern 42 formed on the first coil pattern 41 so as to coat the first coil pattern 41, and may further include the third coil pattern 43 formed on the second coil pattern 42 so as to coat the second coil pattern 42, such that a relatively high aspect ratio (AR) may be implemented, for example, an aspect ratio (AR) (T/W) of 1.1 or more may be shown.

The internal coil part 40 may be coated with an insulation layer 30.

The insulation layer 30 may be formed using a publicly disclosed method such as a screen printing method, a photo resist (PR) exposure and development method, a spraying method, or the like. The internal coil part 40 may be coated with the insulation layer 30, and thus, may not be in direct contact with a magnetic material forming the magnetic body 50.

One end of the internal coil part 40 formed on one surface of the insulation substrate 20 may be exposed to one end surface of the magnetic body 50 in a length direction, and one end of the internal coil part 40 formed on the other surface of the insulation substrate 20 may be exposed to the other end surface of the magnetic body 50 in a length direction.

External electrodes 80 may be formed on both end surfaces of the magnetic body 50 in the length direction thereof so as to be connected to the internal coil parts 40 exposed to both end surfaces of the magnetic body 50 in the length direction. The external electrodes 80 may be extended to upper and lower surfaces of the magnetic body 50 in a thickness direction and/or both side surfaces of the magnetic body 50 in a width direction.

The external electrode 80 may contain a metal having excellent electric conductivity. For example, the external electrode 80 may be formed of nickel (Ni), copper (Cu), tin (Sn), silver (Ag), or the like, alone, or an alloy thereof, or the like.

Method of Manufacturing Chip Electronic Component

Figure 4:
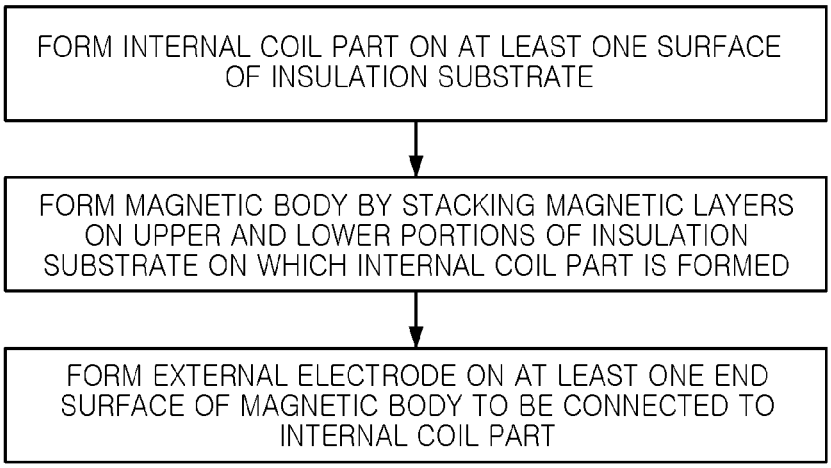
FIG. 4 is a process view illustrating a manufacturing method of a chip electronic component according to an exemplary embodiment of the present disclosure.

FIG. 4 is a process view illustrating a method of manufacturing a chip electronic component according to an exemplary embodiment of the present disclosure, and FIGS. 5 to 9 are views sequentially illustrating processes of a manufacturing method of a chip electronic component according to an exemplary embodiment of the present disclosure.

Referring to FIG. 4, first, the internal coil part 40 may be formed on at least one surface of the insulation substrate 20.

The insulation substrate 20 is not particularly limited. For example, as the insulation substrate 20, a polypropylene glycol (PPG) substrate, a ferrite substrate, a metal-based soft magnetic substrate, or the like, may be used, and the insulation substrate 20 may have a thickness of 40 to 100 μm.

Figure 5:
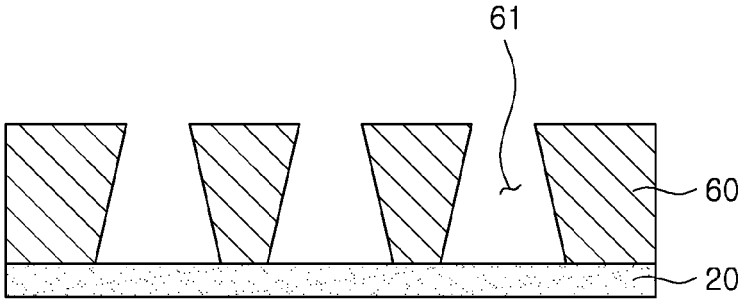
FIGS. 5 to 9 are views sequentially illustrating processes of a method of manufacturing a chip electronic component according to an exemplary embodiment of the present disclosure.

In a method of forming the internal coil part 40, referring to FIG. 5, a plating resist 60 having an open portion 61 for formation of the first coil pattern may be formed on the insulation substrate 20.

As the plating resist 60, a general photosensitive resist film; a dry film resist or the like may be used, but the present disclosure is not particularly limited thereto.

The open portion 61, for the formation of the first coil pattern, may be formed so that a ratio of a top opening width thereof with respect to a bottom opening width thereof is less than 1.

Figure 6:
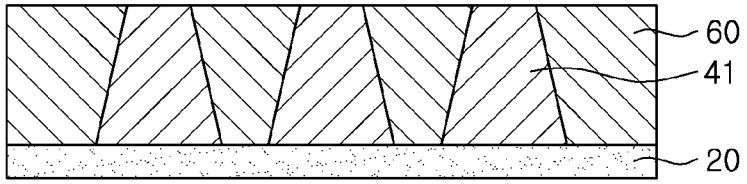

Referring to FIG. 6, the first coil pattern 41 may be formed by filling the open portion 61 with an electric conductive metal using an electroplating process or the like.

The first coil pattern 41 may be made of a metal having excellent electric conductivity. For example, the first coil pattern 41 may be formed of silver (Ag), palladium (Pd), aluminum (Al), nickel (Ni), titanium (Ti), gold (Au), copper (Cu), or platinum (Pt), an alloy thereof, or the like.

In the case of the first coil pattern 41, a ratio a/b of a width a of an upper surface of the first coil pattern 41 with respect to a width b of a lower surface thereof is less than 1, such that the width b of the lower surface may be wider than the width a of the upper surface.

In the case in which the ratio a/b of a width a of an upper surface of the first coil pattern 41 with respect to a width b of a lower surface thereof is 1 or more, for example, in a case in which the width b of the lower surface is the same as or narrower than the width a of the upper surface, due to isotropic growth of the second coil pattern 42 or the third coil pattern 43 formed on the first coil pattern 41 through an electroplating process, a defect such as short circuits may occur in coils and a limitation in terms of increasing an aspect ratio (AR) of a coil may be present.

Therefore, the ratio a/b of the width a of the upper surface of the first coil pattern 41 with respect to the width b of the lower surface thereof may satisfy, for example, $0.5 \leq a/b < 1$.

The width b of the lower surface of the first coil pattern 41 may be 90 to 110 μm, and the width a of the upper surface of the first coil pattern 41 may be 70 to 90 μm.

A cross-section of the first coil pattern 41 may have a thickness direction trapezoidal shape of which a length of a lower surface is greater than that of an upper surface.

Figure 7:
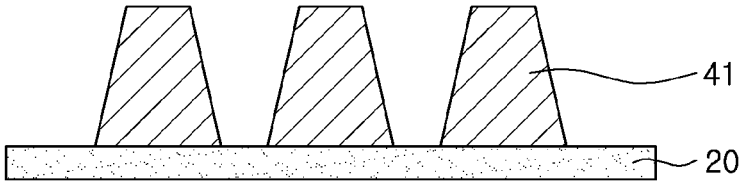

Referring to FIG. 7, the plating resist 60 may be removed using a chemical etching process or the like.

When the plating resist 60 is removed, the first coil pattern 41 in which a ratio a/b of a width a of an upper surface thereof with respect to a width b of a lower surface thereof is less than 1 may remain on the insulation substrate 20.

Figure 8:
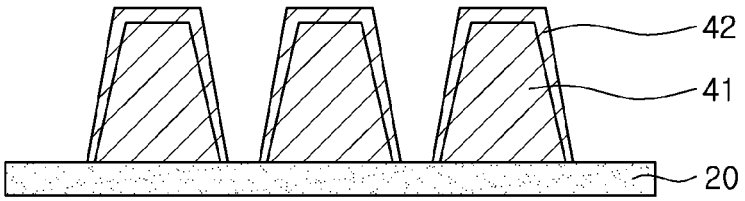

Referring to FIG. 8, the second coil pattern 42 coating the first coil pattern 41 may be formed on the first coil pattern 41 using an electroplating process.

Figure 9:
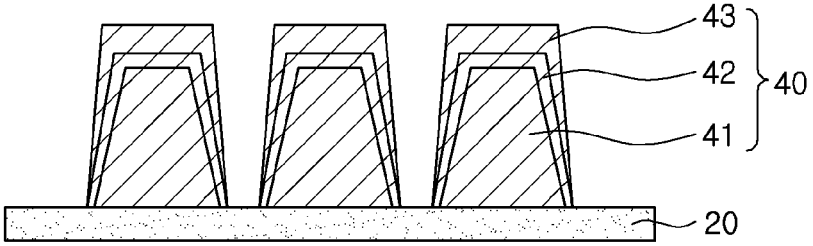

Further, referring to FIG. 9, the third coil pattern 43 coating the second coil pattern 42 may be formed on the second coil pattern 42 using an electroplating process.

The second coil pattern 42 and the third coil pattern 43 may be made of a metal having excellent electric conductivity. For example, The second coil pattern 42 and the third coil pattern 43 may be formed of silver (Ag), palladium (Pd), aluminum (Al), nickel (Ni), titanium (Ti), gold (Au), copper (Cu), or platinum (Pt), an alloy thereof, or the like. The first coil pattern 41, the second coil pattern 42, and the third coil pattern 43 may be formed of a single type of metal, and may be made of, for example, copper (Cu).

The first coil pattern 41 in which the ratio a/b of a width a of an upper surface with respect to a width b of a lower surface thereof is less than 1 may be formed, and the second coil pattern 42 and the third coil pattern 43 may be formed on the first coil pattern 41 so as to coat the first coil pattern 41, thereby promoting growth of the coil in a thickness direction thereof and preventing the occurrence of short circuits between coil patterns. Whereby the internal coil part 40 may have a relatively high aspect ratio (AR).

In the case of the internal coil part 40, the ratio a'/b' of the width a' of the upper surface thereof with respect to the width b' of the lower surface thereof may be less than 1, and the internal coil part 40 may show a relatively high aspect ratio (AR) (T/W) of 1.1 or more.

A via electrode 45 may be formed by forming a hole in a portion of the insulation substrate 20 and filling the hole with a conductive material, and the internal coil parts 40 formed on one surface of the insulation substrate 20 and the other surface thereof may be electrically connected to each other through the via electrode 45.

The hole penetrating through the insulation substrate may be formed in a central portion of the insulation substrate 20 using a drilling process, laser processing, a sand blasting process, or a punching process, or the like.

After the internal coil part 40 is formed, an insulation layer 30 coating the internal coil part 40 may be formed. The insulation layer 30 may be formed using a publicly disclosed method such as a screen printing method, a photo resist (PR) exposure and development method, a spraying method, or the like, but the present disclosure is not limited thereto.

Thereafter, a magnetic body 50 may be formed by stacking a magnetic layer on upper and lower portions of the insulation substrate 20 on which the internal coil part 40 is formed.

The magnetic body 50 may be formed by stacking the magnetic layer on both surfaces of the insulation substrate 20 and pressing the stacked magnetic layer by a lamination method or a hydrostatic pressure method. In this case, a core part 55 may be formed by filling the hole with a magnetic material.

Next, an external electrode 80 may be formed on at least one end surface of the magnetic body 50 to be connected to the internal coil part 40 exposed thereto.

The external electrode 80 may be formed using a conductive paste containing a metal having excellent electric conductivity, and the conductive paste may contain, for example, nickel (Ni), copper (Cu), tin (Sn), or silver (Ag) alone, or an alloy thereof or the like. The external method 80 may be formed through a dipping method or the like, as well as a printing method according to a shape of the external electrode 80.

Other features overlapped with those of the chip electronic component according to the foregoing exemplary embodiment of the present disclosure will be omitted.

With a chip electronic component according to exemplary embodiments of the present disclosure, the occurrence of short circuits between coil patterns may be prevented, and an internal coil having a relatively high aspect ratio (AR) may be implemented by increasing a thickness of a coil with respect to a width thereof.

Therefore, a cross-sectional area of the coil may be increased, direct current resistance (Rdc) may be decreased, and inductance may be improved.

While exemplary embodiments have been shown and described above, it will be apparent to those skilled in the art that modifications and variations could be made without departing from the spirit and scope of the present disclosure as defined by the appended claims.

What is claimed is:

1. A chip electronic component comprising:

a magnetic body including an insulation substrate;

an internal coil part disposed on at least one surface of the insulation substrate; and an external electrode disposed on an end surface of the magnetic body and connected to the internal coil part, wherein the internal coil part includes a first coil pattern disposed on the insulation substrate and a second coil pattern disposed on the first coil pattern as a coating layer to coat an upper surface and side surfaces of the first coil pattern, a ratio a/b is less than 1 and a ratio a/b is less than a ratio a'/b' where a represents a width of an upper surface of the first coil pattern, b represents a width of a lower surface of the first coil pattern, a' represents a width of an upper surface of the internal coil part, and b' represents a width of a lower surface of the internal coil part, and the second coil pattern is a plating layer disposed to coat the first coil pattern.

2. The chip electronic component of claim 1, wherein the ratio a/b of the width a of the upper surface of the first coil pattern with respect to the width b of the lower surface thereof satisfies $0.5 \leq a/b < 1$.

3. The chip electronic component of claim 1, wherein a cross-section of the first coil pattern may have a thickness direction trapezoidal shape of which a length of a lower surface is greater than that of an upper surface.

4. The chip electronic component of claim 1, wherein the width b of the lower surface of the first coil pattern is 90 μm to 110 μm.

5. The chip electronic component of claim 1, wherein the width a of the upper surface of the first coil pattern is 70 μm to 90 μm.

6. The chip electronic component of claim 1, wherein the internal coil part further comprises a third coil pattern formed to coat the second coil pattern.

7. The chip electronic component of claim 1, wherein a ratio a'/b' of a width a' of an upper surface of the internal coil part with respect to a width b' of a lower surface thereof is less than 1.

8. The chip electronic component of claim 1, wherein the internal coil part contains one or more selected from a group consisting of silver (Ag), palladium (Pd), aluminum (Al), nickel (Ni), titanium (Ti), gold (Au), copper (Cu), and platinum (Pt).

9. The chip electronic component of claim 1, wherein the first coil pattern and the second coil pattern are formed of a single type of metal.

10. The chip electronic component of claim 1, wherein the internal coil part has an aspect ratio of 1.1 or more.

11. The chip electronic component of claim 1, wherein the first coil pattern is a seed layer of the plating layer of the second coil pattern.

12. The chip electronic component of claim 1, wherein the internal coil part further comprises a third coil pattern formed to coat the second coil pattern and formed of a same type of metal as the second coil pattern.

13. The chip electronic component of claim 1, wherein the internal coil part further comprises a third coil pattern formed to coat the second coil pattern, and the first, second, and third coil patterns are formed of a single type of metal.

* * * * *